US008487724B2

(12) United States Patent
Fleege

(10) Patent No.: US 8,487,724 B2
(45) Date of Patent: Jul. 16, 2013

(54) FULLY ENCLOSED ELECTRONIC TRIP UNIT FOR A MOLDED CASE CIRCUIT BREAKER

(75) Inventor: Dennis W. Fleege, Cedar Rapids, IA (US)

(73) Assignee: Schneider Electric USA, Inc., Palatine, IL (US)

( * ) Notice: Subject to any disclaimer, the term of this patent is extended or adjusted under 35 U.S.C. 154(b) by 0 days.

(21) Appl. No.: 12/952,408

(22) Filed: Nov. 23, 2010

(65) Prior Publication Data

US 2012/0125748 A1 May 24, 2012

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 9/30*** | (2006.01) |
| ***H01H 9/02*** | (2006.01) |
| ***H01H 13/04*** | (2006.01) |

(52) U.S. Cl.
USPC ..... 335/202; 335/201; 335/8

(58) Field of Classification Search
USPC ..... 335/8, 132, 172, 202
See application file for complete search history.

(56) References Cited

U.S. PATENT DOCUMENTS

| | | | | |
|---|---|---|---|---|
| 3,299,378 | A * | 1/1967 | Scheib, Jr. | 335/131 |
| 3,331,039 | A * | 7/1967 | McGary | 335/132 |
| 4,382,240 | A * | 5/1983 | Kondo et al. | 335/8 |
| 4,540,961 | A * | 9/1985 | Maier | 335/16 |
| 4,845,460 | A * | 7/1989 | Manthe et al. | 335/201 |
| 4,975,667 | A * | 12/1990 | Morgan et al. | 335/202 |
| 5,262,744 | A * | 11/1993 | Arnold et al. | 335/8 |
| 5,278,531 | A * | 1/1994 | Link et al. | 335/202 |
| 5,534,674 | A * | 7/1996 | Steffens | 218/154 |
| 6,236,294 | B1 * | 5/2001 | Zindler et al. | 335/172 |
| 6,452,470 | B1 * | 9/2002 | Malingowski et al. | 335/202 |
| 6,509,817 | B2 * | 1/2003 | Kaneko et al. | 335/201 |
| 6,853,279 | B1 * | 2/2005 | Puskar et al. | 335/172 |
| 6,995,640 | B2 * | 2/2006 | Harmon et al. | 335/172 |
| 8,093,973 | B2 * | 1/2012 | Takaya et al. | 335/133 |
| 2003/0112104 | A1 * | 6/2003 | Douville et al. | 335/172 |
| 2005/0024172 | A1 | 2/2005 | Puskar et al. | |

FOREIGN PATENT DOCUMENTS

| | | | |
|---|---|---|---|
| DE | 10013116 | A1 | 10/2001 |
| EP | 1748458 | A1 | 1/2007 |

OTHER PUBLICATIONS

Four photographs of a sealing gasket used in a MICROLOGIC trip unit of a POWERPACT circuit breaker (1 page) (more than a year before Nov. 23, 2010).

International Search Report corresponding to co-pending International Patent Application Serial No. PCT/US2011/057449, European Patent Office, dated Feb. 2, 2012; (5 pages).

(Continued)

*Primary Examiner* — Alexander Talpalatski
(74) *Attorney, Agent, or Firm* — Nixon Peabody LLP

(57) ABSTRACT

A molded case circuit breaker having a trip unit with one or more integrally formed dielectric protrusions that are configured to slidably interconnect with corresponding dielectric members of the base when the trip unit is secured to the base. The dielectric protrusions extend from dielectric walls located between adjacent enclosure chambers that house the current transformers and are configured to remain in contact with the dielectric members of the base as the trip unit is being moved with respect with the base. By remaining in contact to one another while the trip unit is moved with respect to the base, the dielectric protrusions, along with the dielectric members, maintain a strong dielectric barrier within the exterior spaces between the CT enclosure chambers, thereby preventing debris from traveling between and accumulating on the trip unit and the base.

15 Claims, 9 Drawing Sheets

OTHER PUBLICATIONS

International Written Opinion corresponding to co-pending International Patent Application Serial No. PCT/US2011/57449, European Patent Office, dated Feb. 2, 2012; (8 pages).

Anonymous: "Moulded Case Circuit Breaker—Product Catalogue", Square D by Schneider Electric; Dated Dec. 1, 2008; (53 pages).

* cited by examiner

FULLY ENCLOSED ELECTRONIC TRIP UNIT FOR A MOLDED CASE CIRCUIT BREAKER

FIELD OF THE INVENTION

The invention relates to current sensor assemblies, and more particularly, to a fully enclosed electronic trip unit having dielectric protrusions configured to interconnect with dielectric members of a base when assembling a molded case circuit breaker.

BACKGROUND

Molded case circuit breakers include a single phased or multi-phased trip unit and a base, whereby the trip unit can be installed or removed from the base module. However, due to the number of components in the trip unit and the base as well as the space requirements of the circuit breaker, the amount of spacing between the trip unit and the base is extremely limited.

FIG. 1A illustrates a front view of an existing example molded case circuit breaker with a trip unit coupled to the base. As shown, the trip unit 10 includes three dielectric enclosures 11, each of which houses a current transformer (CT) 12 and represents a phase. The enclosures 11 are separated by dielectric walls 14 located in exterior spaces between the enclosures 11 of the trip unit 10. The base 20 in FIG. 1A includes a bottom surface 22 from which a pair of dielectric members 24 vertically extend upwards. When the trip unit 10 is secured to the base 20, the dielectric members 24 and the dielectric walls 14 are positioned to be vertically aligned with one another, as shown in FIG. 1A. However, as shown in FIG. 1A, a small horizontal space (represented by arrows 25) is present between the dielectric walls 14 and the dielectric members 24 when the trip unit 10 is secured to the base 20.

If the circuit breaker has interrupted an electrical fault, i.e. tripped, the trip unit 10 can be displaced from the base 20, by pressure build up of escaping arc gases between the unit 10 and the base 20, thereby causing debris from the interruption to travel along the vents 26 between the bottom surface 16 of the trip unit 10 and the bottom surface 22 of the base 20. As shown in FIG. 1B, as the trip unit 10 is displaced vertically away from the base 20, the horizontal spaces between the bottom of the dielectric walls 14 and the top of the dielectric members 24 increases. The escaping gases will cause a substantial amount debris to travel freely (as shown by the arrows) between the trip unit 10 and the base 20. This results in debris accumulating on the trip unit 10, the base 20 and areas between the two components. This accumulation of debris can eventually result in a breakdown in the dielectric path between the phases of the trip unit 10.

The present disclosure is directed to a molded case circuit breaker having a multi-phase trip unit and base that include interconnecting dielectric protrusions and dielectric members, respectively, that maintain a dielectric barrier between the different phases of the trip unit during a circuit breaker interrupt.

BRIEF SUMMARY

The present disclosure is directed to a molded case circuit breaker having a trip unit that has one or more integrally formed dielectric protrusions that are configured to slidably interconnect with corresponding dielectric members of the base when the trip unit is secured to the base. The dielectric protrusions extend from the dielectric walls located in exterior spaces between adjacent enclosure chambers that house the current transformers. The dielectric protrusions are configured to remain interconnected with the dielectric members of the base when the trip unit moved with respect to the base. By remaining interconnected to one another during an interruption, the dielectric protrusions, along with the dielectric members, maintain a dielectric barrier between the enclosure chambers. The maintained dielectric barrier is also a physical barrier which reduces the accumulation of debris, which is generated during a trip event, between the trip unit and the base.

BRIEF DESCRIPTION OF THE DRAWINGS

The foregoing and other advantages of the invention will become apparent upon reading the following detailed description and upon reference to the drawings.

Figure 1A:
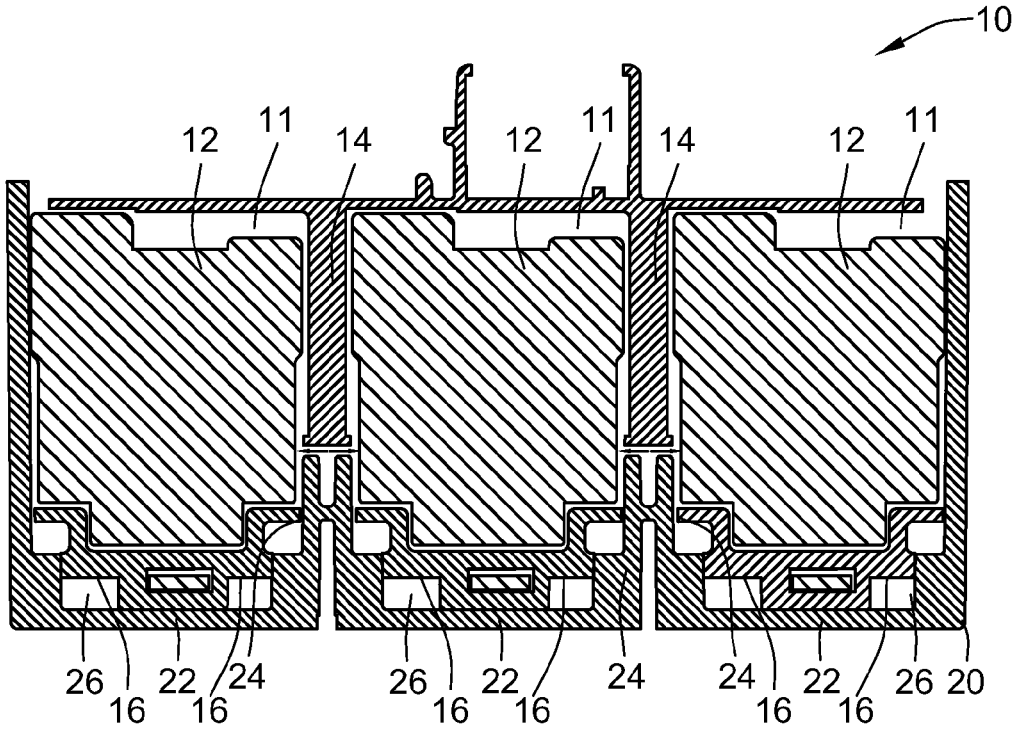
FIG. 1A (PRIOR ART)
FIGS. 1A-1B illustrate front view schematics of an existing molded case circuit breaker in accordance with the prior art.
Figure 1B:
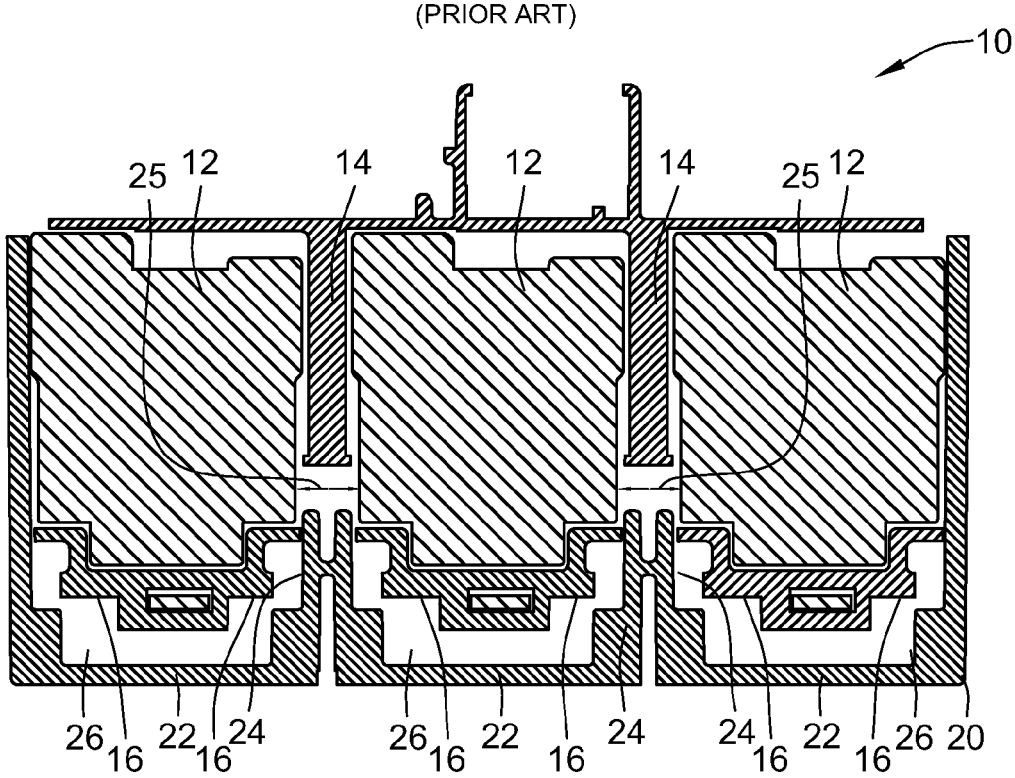
FIG. 1B (PRIOR ART)

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

Figure 2A:
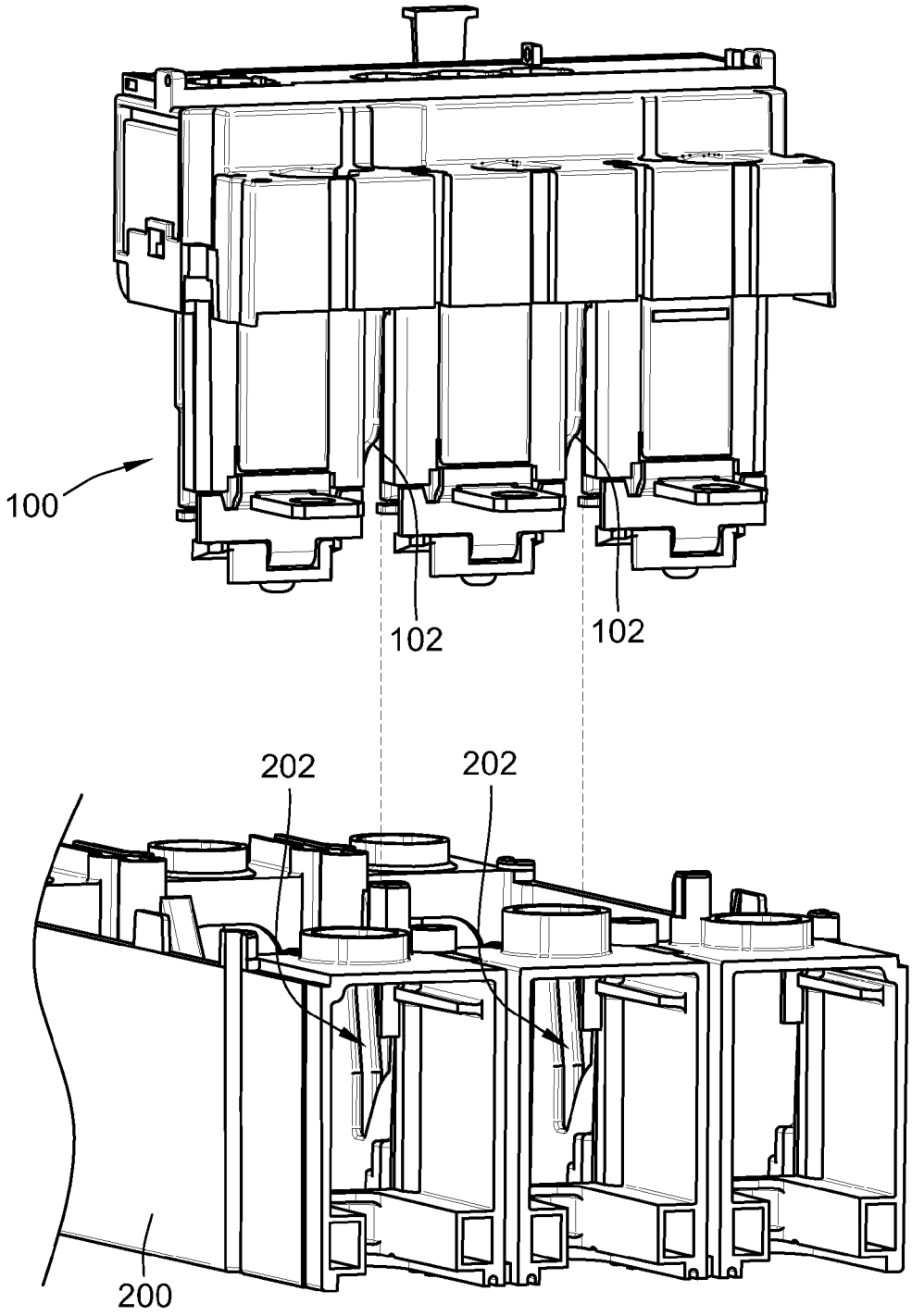
FIGS. 2A-2B illustrate exploded views of a trip unit and a base of a molded case circuit breaker in accordance with an aspect of the present disclosure.
Figure 2B:
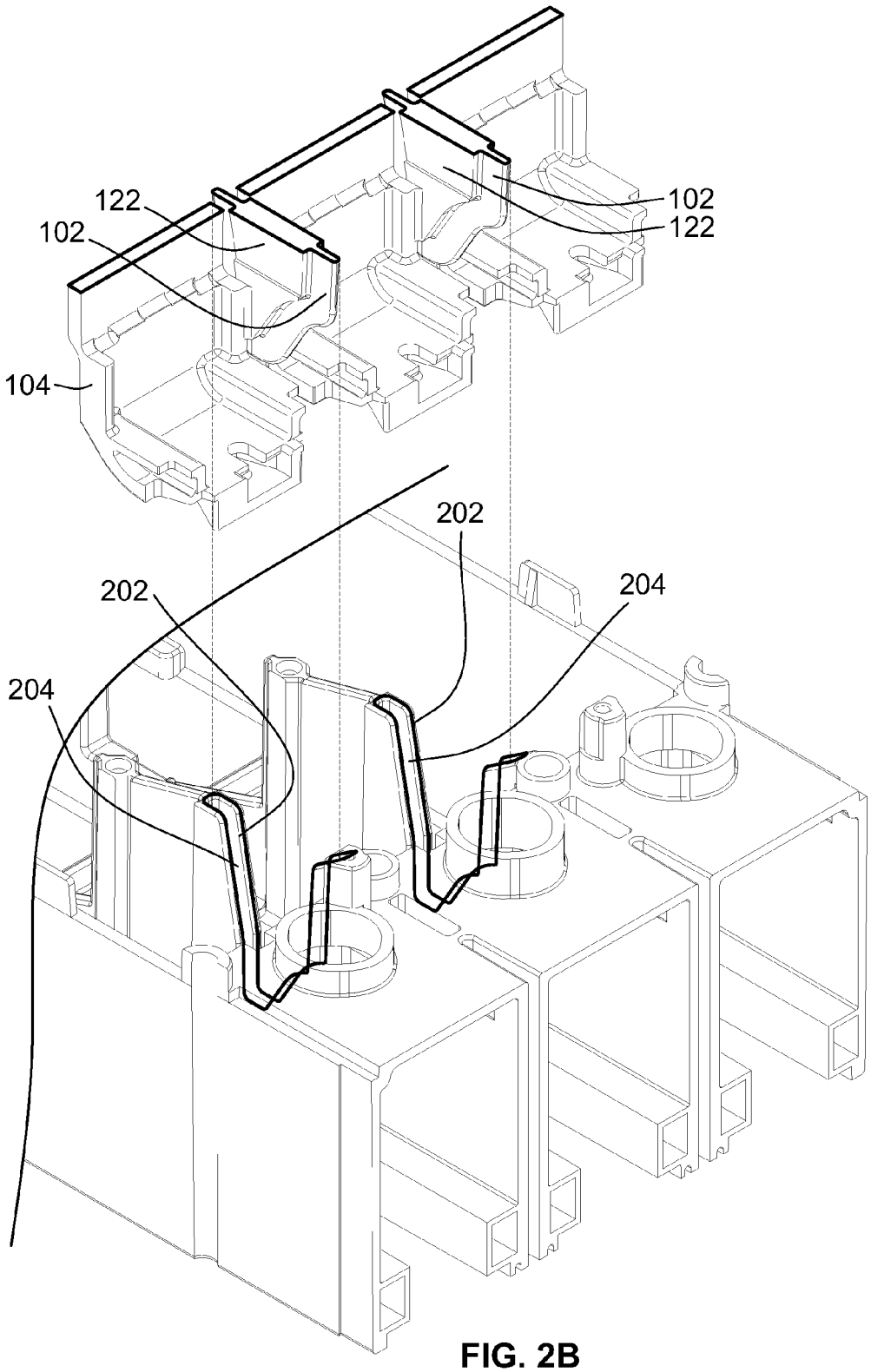

FIGS. 2A-2B illustrate isometric, exploded views of a trip unit and a base of a molded case circuit breaker in accordance with an aspect of the present disclosure. In particular, the circuit breaker includes an installable single or multi-phase trip unit 100 and a circuit breaker base 200 that receives and engages the trip unit 100. It should be noted that the configurations of the trip unit 100 and/or circuit breaker base 200 shown in the figures are exemplary and are not limited to those shown in the figures.

As shown in FIGS. 2A and 2B, the trip unit 100 includes one or more vertically extending dielectric walls 122 coupled to at least a portion of the trip unit's housing 101 (FIG. 3), as well as dielectric protrusions 102 that are integrally formed with the dielectric walls 122. Additionally, the base 200 includes a plurality of correspondingly spaced dielectric members 202, in that the dielectric members 202 are configured to have a U-shaped groove 204, as shown in FIGS. 2A-2B. The dielectric protrusions 102 of the trip unit 100 are slidably inserted into and thereby interlockingly engage the corresponding dielectric members 202 of the base 200 when the trip unit 100 is coupled to the base 200. This engagement between the dielectric protrusions 102 and the dielectric members 202 form and maintain dielectric barriers that maximize dielectric insulation. Also, the dielectric barriers minimize accumulation of debris between the trip unit 100 and the base 200 in the event that the installed trip unit 100 and the base 200 move apart from one another.

Figure 3:
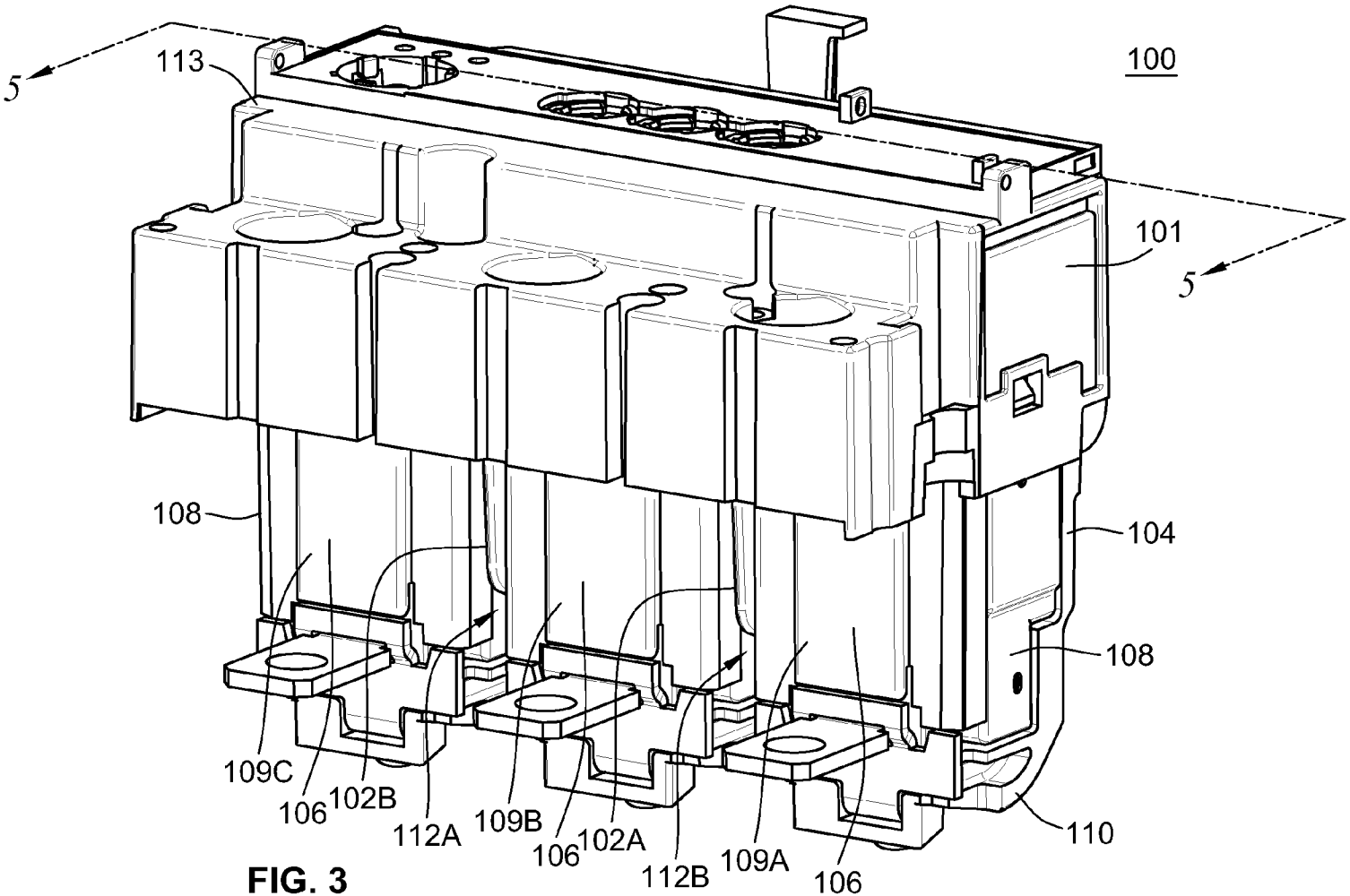
FIG. 3 illustrates an isometric view of a trip unit in accordance with an aspect of the present disclosure.
Figure 4:
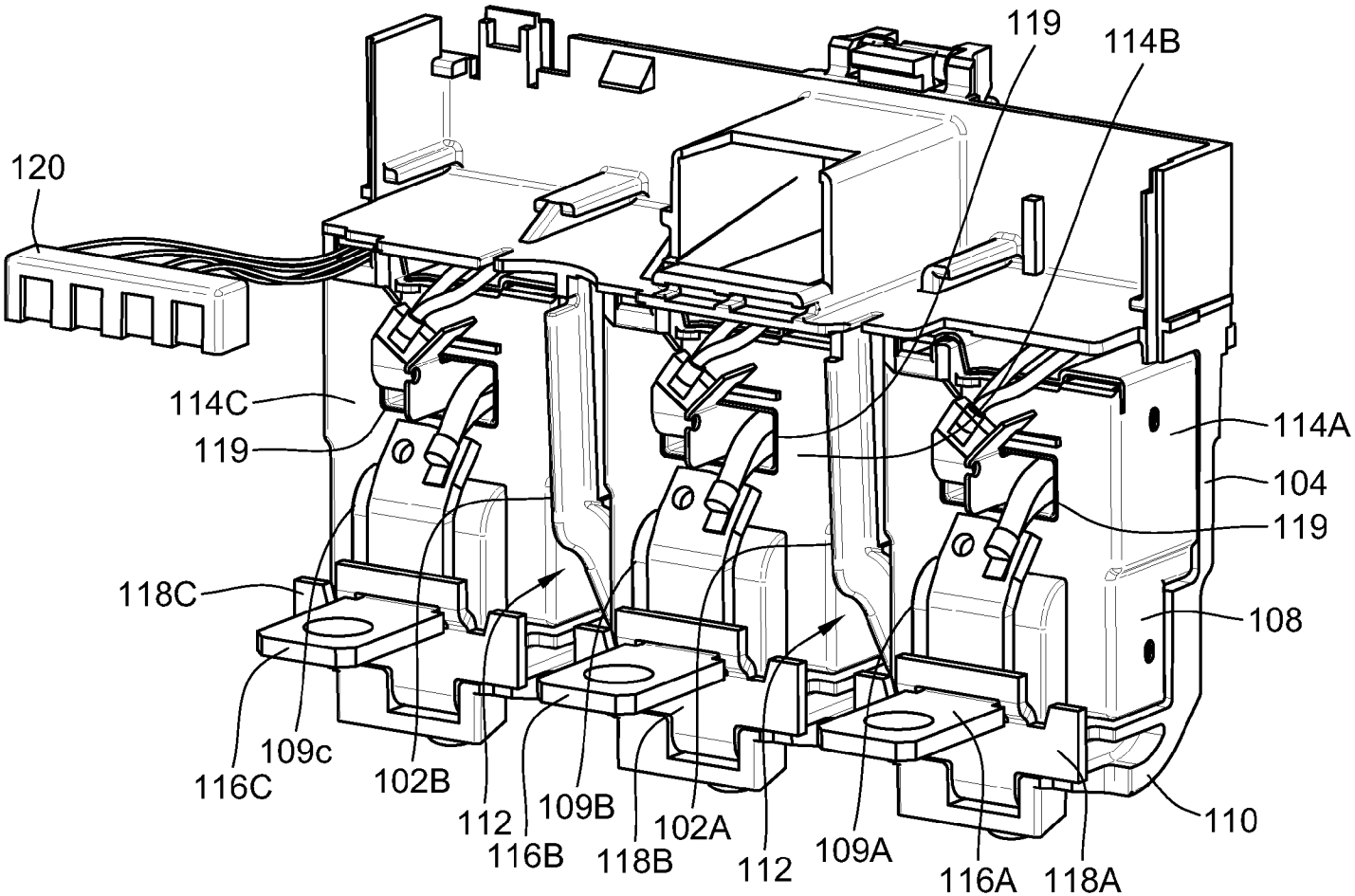
FIG. 4 illustrates an isometric view of the trip unit showing some of its internal components in accordance with an aspect of the present disclosure.

FIG. 3 illustrates an isometric view of the trip unit in accordance with an aspect of the present disclosure. FIG. 4 illustrates an isometric view of the trip unit shown in FIG. 3 with some of its internal components shown in accordance with an aspect of the present disclosure. As shown in FIG. 3, the trip unit 100 includes a housing 101 that includes a plurality of outer faces coupled to one another. In particular, as shown in FIG. 3, the housing 101 includes a back outer face 104 and a front outer face (also referred to as a thermal barrier) 106 coupled to one another to form a plurality of enclosure chambers 109A, 109B, 109C.

In an aspect, the back outer face 104 is partitioned into discreetly separated outer face portions which eventually form the enclosure chambers 109. The bottom of the back outer face 104 has flanged bottom surfaces 110, as shown in FIG. 3, that couples and secures the individual current transformers 114 thereto. The front outer face 106 may also be partitioned into discreetly separated outer face portions which eventually form the enclosure chambers 109 which at least partially house the current transformers 114. The front outer face 106 not only serves to form the separated enclosure chambers 109 and protect the internal components of the trip unit 100, but also provides a pollution seal that reduces or minimizes the amount of debris from entering the trip unit when the circuit breaker is interrupted. The front and back outer faces 104, 106 of the trip unit as well as the base are made of dielectric material.

The trip unit 100 also includes a cover 113 that fits over the back and front outer faces 104, 106 to enclose the enclosure chambers 109 and the current transformers 114 (FIG. 4), printed wire assembly (not shown), one or more output terminals 120 (FIG. 4) and other components. Although not every component shown in FIG. 3 is described herein, those of ordinary skill in the art will be familiar with the components that are not discussed in detail and are not necessary to the understanding of the present disclosure. It should be noted that although a three phase trip unit and base are shown in the Figures and described herein, it is contemplated that the trip unit and base can be configured to have a greater or lesser number of phases depending on the application and use of the circuit breaker.

As shown in FIGS. 3 and 4, the back and front outer faces 104, 106 are configured such that the enclosure chambers 109A, 109B, 109C which house the current transformers 114 (and thus form the individual phases of the trip unit) are separated from one another by exterior spaces 112A, 112B (generally referred to as 112). In particular, as shown in FIG. 3, the trip unit 100 includes a first exterior space 112A between adjacent enclosure chambers 109A and 109B as well as a second exterior space 112B between adjacent enclosure chambers 109B and 109C.

The current transformers 114 in the trip unit 100 are primarily used for sensing and as a power supply for electronics, and the trip unit 100 is configured to allow a plurality of different combinations of current paths or phases. In particular to the exemplary trip unit 100 in FIG. 4, current transformers 114A 114B, 114C include a low amp terminal 116B coupled to a terminal brace 118B in that the low amp terminals 116A, 116B, 116C are welded or brazed to a pigtail component 119. It will be appreciated that the trip unit could be configured with high amp or medium amp terminals if desired. Although only one output terminal is shown in FIG. 4, the trip unit 100 may utilize a plurality of output terminals 120 for transmitting output signals from the current transformers 114.

Figure 5:
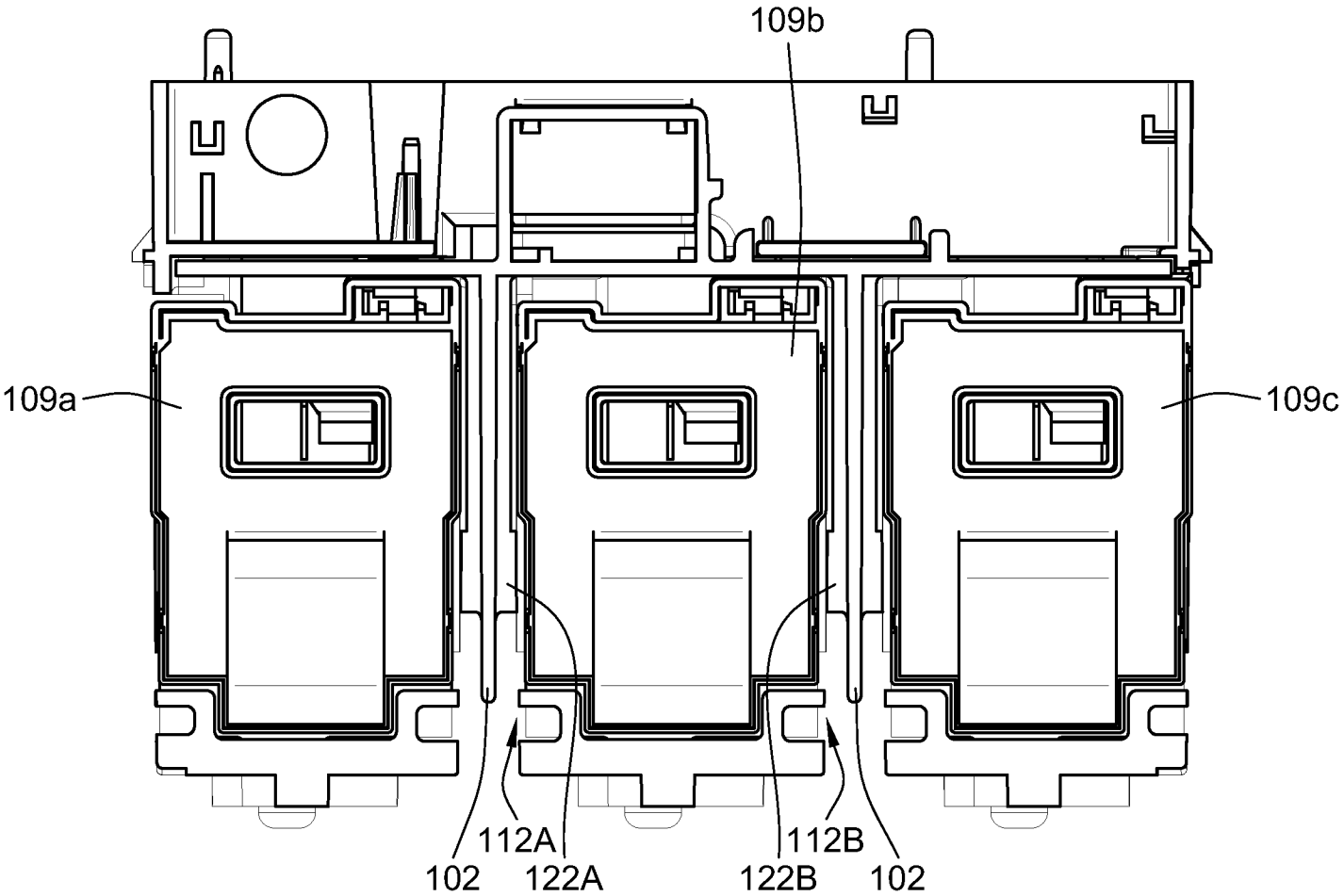
FIG. 5 illustrates a cut-away view of the housing of the trip unit in FIG. 3 along line 5-5 in accordance with an aspect of the present disclosure.

FIG. 5 illustrates a cut-away view of the housing of the trip unit shown in FIG. 3 along line 5-5 in accordance with an aspect of the present disclosure. As discussed above, the trip unit 100 includes an integrally formed dielectric wall 122 positioned within each of the exterior spaces 112 between the enclosure chambers 109. In particular to that shown in FIG. 5, the trip unit 100 includes a dielectric wall 122A within a first exterior space 112A between enclosure chambers 109A and 109B as well as another dielectric wall 122B within a second exterior space 112B between enclosure chambers 109B and 109C. In an aspect, each dielectric wall 122A, 112B has a first width dimension that spans the width of the exterior space 112 between adjacent enclosure chambers 109.

Additionally, the trip unit 100 is configured such that each dielectric wall 122A, 122B incorporates an integral dielectric protrusion 102A, 102B in accordance with the present disclosure. In particular, each protrusion 102A, 102B has a second width dimension which allows the protrusions 102A, 102B to be slidably inserted into and interconnected with a correspondingly sized U-shaped groove 204 of the dielectric member 202 located in the base 200. In an aspect, the dielectric protrusions 102 are molded with and thus integrally formed as part of the dielectric walls 122. It is alternatively contemplated that the dielectric protrusions 102 are manufactured separately from the dielectric walls 122 and are secured to the dielectric walls 122 by appropriate manufacturing processes.

The dielectric protrusions 102 extend from the dielectric walls 122, whereby the second width dimension is smaller than the first width dimensions of the dielectric walls 122. However, it should be noted that the dielectric protrusions 102 shown in the figures are only one configuration and are therefore not limited to those shown. Nonetheless, it is contemplated that the dielectric protrusions 102 to be configured to allow them to interface and interconnect with corresponding dielectric members 202 in the base 200.

Figure 6:
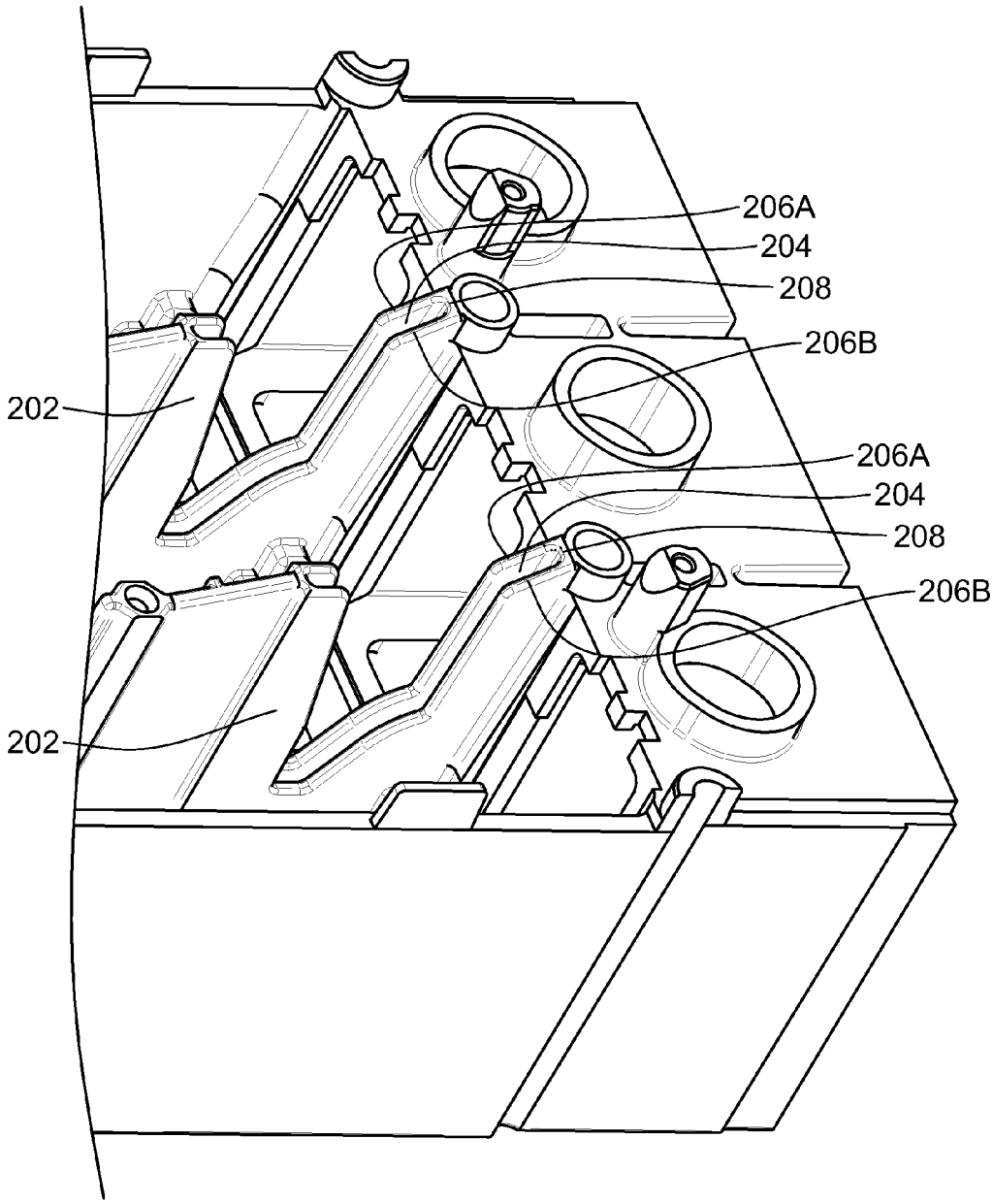
FIG. 6 illustrates an isometric view of the dielectric members of the base in accordance with an aspect of the present disclosure.

FIG. 6 illustrates an isometric view of the dielectric members of the base in accordance with an aspect of the present disclosure. In an aspect, the dielectric members 202 in the base 200 have grooves 204 with a U-shaped configuration. In particular, each dielectric member 202 has two opposing side walls 206A, 206B and a back wall 208 that define the U-shaped groove 204 which receives the protrusion 102 as it is slidably inserted into or removed from the groove 204 when the trip unit 100 is moved with respect to the base 200. In an aspect, as the trip unit 100 is secured to the base 200, the dielectric protrusions 102 slidably enter the grooves 204. In an aspect, upon removing the trip unit 100 from the base 200, the dielectric protrusion 102 slidably exits the groove 204. As discussed in more detail below, the dielectric barrier will be maintained as long as the dielectric protrusions 102 are at least partially in contact with the dielectric members 202.

Figure 7A:
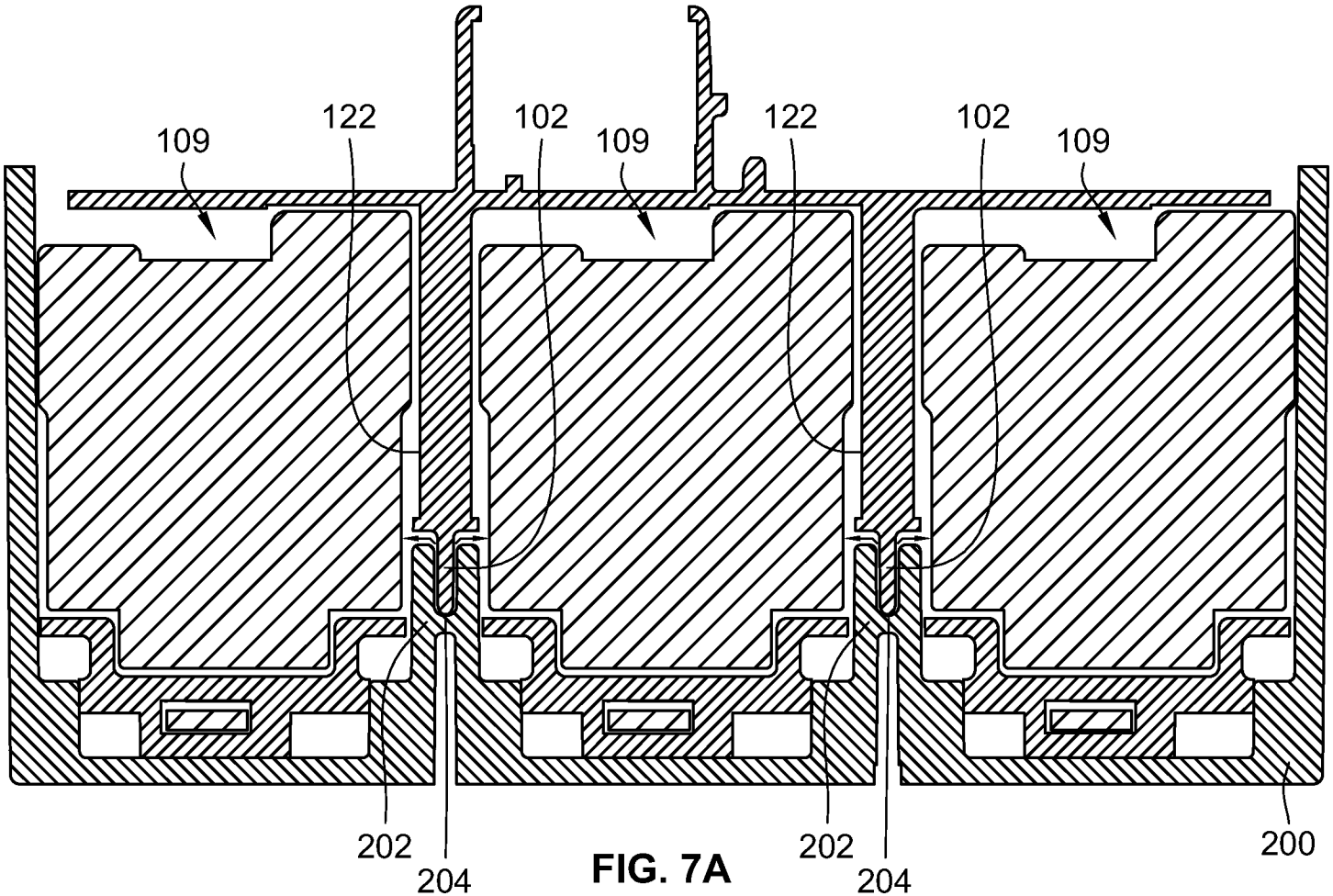
FIG. 7A illustrates a cross-sectional view of the trip unit coupled to the base in accordance with an aspect of the present disclosure.

FIG. 7A illustrates a cross-sectional view of the trip unit 100 coupled to the base 200 in accordance with an aspect of the present disclosure. As shown in FIG. 7A, the dielectric protrusions 102 are inserted into and are interconnected with the corresponding grooves 204 of the dielectric members 202 in the base.

In operation, during a circuit breaker interrupt, if the trip unit 100 is forced away from the base 200, the dielectric protrusions 102 slidably move upward along the grooves 204 of the dielectric members 202. Since the dielectric protrusion 102 remains at least partially in contact with the correspondingly grooved dielectric member 202 as the trip unit 100 is moved, a dielectric barrier is formed and maintained between the trip unit 100 and the base 200 within the exterior spaces 112. Maintenance of this dielectric barrier also prevents debris from entering into and accumulating in the exterior spaces 112 between the trip unit 100 and the base 200 during a trip event. This maintenance of the dielectric barrier results in less debris traveling and accumulating between the trip unit and the base. As stated above, accumulated debris between the phases of the trip unit may cause a dielectric path breakdown.

Figure 7B:
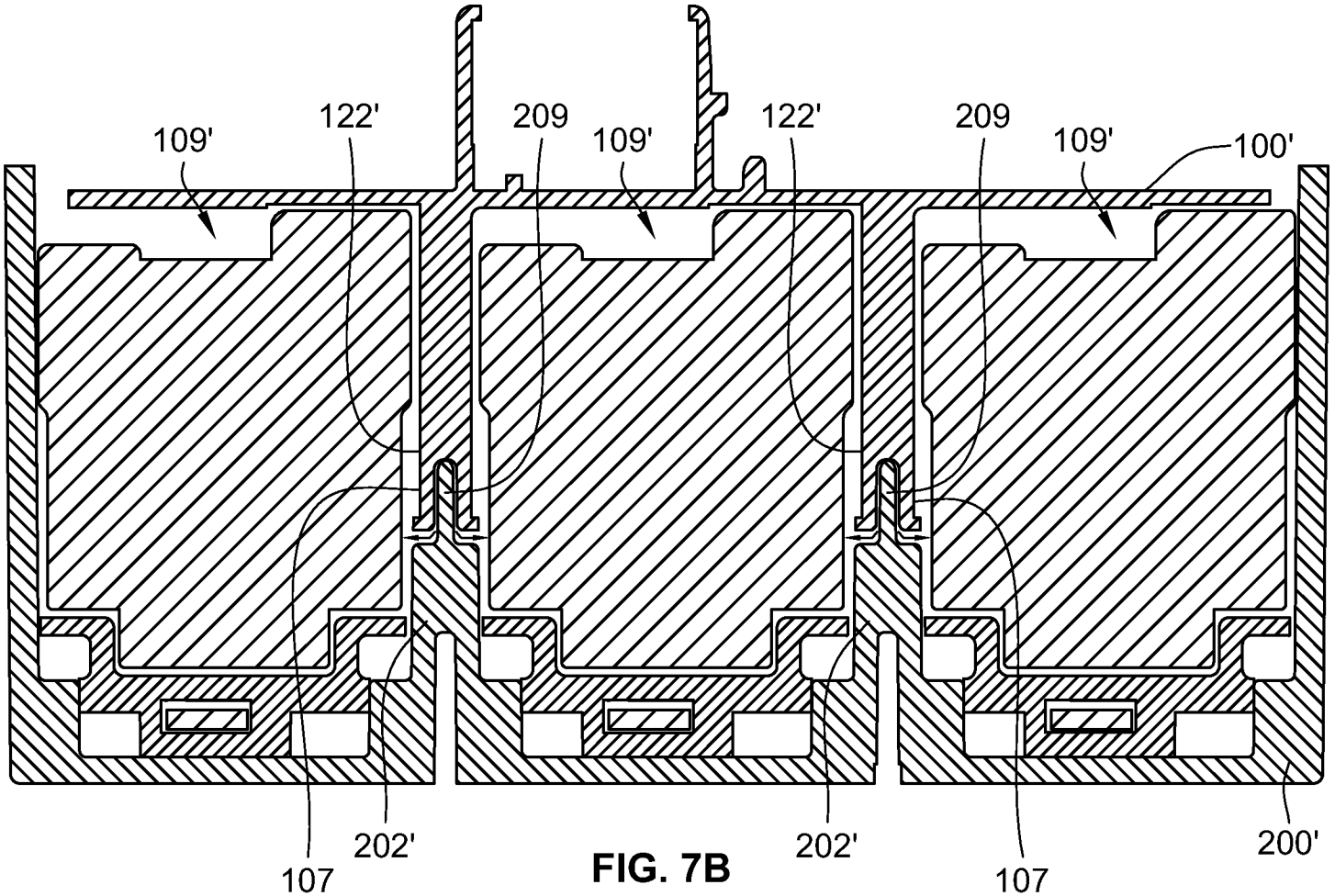
FIG. 7B illustrates a cross-sectional view of the trip unit coupled to the base in accordance with another aspect of the present disclosure.

It is also contemplated that the interconnecting male and female dielectric protrusion and groove components of the trip unit and the base may be reversed. FIG. 7B illustrates a cross-sectional view of the trip unit coupled to the base in accordance with another aspect of the present disclosure. As shown in FIG. 7B, the trip unit 100' possesses U-shaped dielectric members 107 extending from the dielectric walls 122' positioned between enclosure chambers 109'. The U-shaped, female, dielectric members 107 of the trip unit 100' receive and surround male dielectric protrusions 209 vertically extending from the dielectric members 202' at the bottom of the base 200' to form a dielectric barrier when the trip unit 100' and the base 200' are coupled together.

While particular embodiments and applications of the present invention have been illustrated and described, it is to be understood that the invention is not limited to the precise construction and compositions disclosed herein and that various modifications, changes, and variations can be apparent from the foregoing descriptions without departing from the spirit and scope of the invention as defined in the appended claims.

What is claimed is:

1. An electronic trip unit for a molded case circuit breaker, the trip unit comprising:

a housing having a plurality of outer faces coupled to one another to form a plurality of enclosed chambers within the housing, wherein the housing is configured to separate the plurality of enclosed chambers and create a first exterior space between adjacent first and second ones of the enclosed chambers;

a plurality of current transformers coupled to the housing, wherein each current transformer is housed within a respective enclosed chamber;

a first dielectric wall coupled to the housing and positioned within the first exterior space, the first dielectric wall having a first width dimension;

a first dielectric protrusion extending away from and along a peripheral edge of the first dielectric wall to allow the trip unit to move relative to a base of the molded circuit breaker during a trip event while maintaining a dielectric barrier between the trip unit and the base, the first dielectric protrusion having a second width dimension less than the first width dimension along an entirety of the first dielectric protrusion, the first dielectric protrusion being configured to be slidably inserted within a corresponding grooved dielectric member in the base when the trip unit is coupled to the base.

2. The trip unit of claim 1, wherein the housing is configured to create a second exterior space between adjacent second and third ones of the enclosed chambers, wherein a second dielectric wall is coupled to the housing and positioned within the second exterior space, the second dielectric wall having a first width dimension.

3. The trip unit of claim 2, further comprising a second dielectric protrusion extending away from and along a peripheral edge of the second dielectric wall, wherein the second dielectric protrusion has a second width dimension smaller than the first width dimension of the second dielectric wall.

4. The trip unit of claim 3, wherein the second dielectric protrusion is configured to be slidably inserted within a corresponding grooved dielectric member in the base when the trip unit is coupled to the base.

5. The trip unit of claim 1, wherein at least one of the plurality of outer faces is made of a dielectric material.

6. The trip unit of claim 3, wherein the first dielectric protrusion and the second dielectric protrusion are molded to be integrally part of the respective first and second dielectric walls.

7. A circuit breaker comprising:

a base having a first dielectric member; and an electronic trip unit comprising:

a housing having a plurality of outer faces coupled to one another to form a plurality of enclosed chambers within the housing, wherein the housing is configured to separate the plurality of enclosed chambers and create a first exterior space between adjacent first and second ones of the enclosed chambers;

a plurality of current transformers coupled to the housing, wherein each current transformer is housed within a respective enclosed chamber;

a first dielectric wall coupled to the housing and positioned within the first exterior space, the first dielectric wall having a first width dimension;

a first dielectric protrusion extending from the first dielectric wall to allow the trip unit to move relative to the base during a trip event while maintaining a dielectric barrier between the trip unit and the base, wherein the first dielectric protrusion has a second width dimension less than the first width dimension of the first dielectric wall along an entirety of the first dielectric protrusion, the first dielectric protrusion being configured to be slidable relative to the first dielectric member when the trip unit is coupled to the base;

wherein the base is coupled to the trip unit to form the circuit breaker, and wherein the first dielectric member is configured to engage the first dielectric protrusion of the trip unit.

8. The circuit breaker of claim 7, wherein the first dielectric protrusion is configured to fit within a U-shaped groove of the first dielectric member when the trip unit is coupled to the base.

9. The circuit breaker of claim 7, wherein the first dielectric protrusion of the trip unit has a U-shaped groove and the first dielectric member of the base has a protrusion that extends away from and along a peripheral edge of the first dielectric member, wherein the protrusion is configured to be slidably inserted into the U-shaped groove as the trip unit is moved with respect to the base.

10. The circuit breaker of claim 7, wherein the housing of the trip unit further comprises a second dielectric wall and the base further comprises a second dielectric member configured to engage with the dielectric wall when the trip unit is coupled to the base.

11. The circuit breaker of claim 10, wherein the second dielectric wall has a first width dimension and the second dielectric protrusion has a second width dimension smaller than the first width dimension, and wherein the second dielectric protrusion extends away from and along a peripheral edge of the second dielectric wall.

12. The circuit breaker of claim 10, wherein the second dielectric member has a U-shaped groove and the second dielectric wall has a dielectric protrusion configured to be slidably inserted into the U-shaped groove of the second dielectric member, wherein the dielectric protrusion extends away from and along a peripheral edge of the second dielectric wall.

13. The circuit breaker of claim 10, wherein the second dielectric member has a dielectric protrusion and the second dielectric wall has a U-shaped groove, wherein the dielectric protrusion is configured to be slidably inserted into the U-shaped when the trip unit is moved with respect to the base, and wherein the dielectric protrusion extends away from and along a peripheral edge of the second dielectric member.

14. A circuit breaker comprising:

an electronic trip unit comprising:

a housing having a plurality of outer faces coupled to one another to form a plurality of enclosed chambers within the housing, wherein the housing is configured to separate the plurality of enclosed chambers and create a first exterior space between adjacent first and second ones of the enclosed chambers;

a plurality of current transformers coupled to the housing, wherein each current transformer is housed within a respective enclosed chamber;

a first dielectric wall coupled to the housing and positioned within the first exterior space, the first dielectric wall having a first width dimension; and a base coupled to the trip unit to form the circuit breaker, wherein the base includes a first dielectric member configured to be placed in opposition to and slidingly engage the first dielectric wall of the trip unit when the base is coupled to the trip unit such that the trip unit is allowed to move relative to the base during a trip event while maintaining a dielectric barrier between the trip unit and the base;

wherein the first dielectric member or the first dielectric wall has a groove formed of dielectric material for receiving a dielectric protrusion of the other of the first dielectric member or the first dielectric wall, when the first dielectric member and the first dielectric wall are placed in opposition, the dielectric protrusion having a second width dimension that is less than the first width dimension along an entirety of the first dielectric protrusion, the first dielectric protrusion extending away from and along a peripheral edge of the other of the first dielectric member or the first dielectric wall;

wherein when the trip unit is coupled to the base the first dielectric member and the first dielectric wall form a dielectric and physical barrier during the trip event to allow the trip unit to move relative to the base.

15. A circuit breaker comprising:

an electronic trip unit comprising:

a housing having a plurality of outer faces coupled to one another to form a plurality of enclosed chambers within the housing, wherein the housing is configured to separate the plurality of enclosed chambers and create a first exterior space between adjacent first and second ones of the enclosed chambers;

a plurality of current transformers coupled to the housing, wherein each current transformer is housed within a respective enclosed chamber;

a first dielectric wall coupled to the housing and positioned within the first exterior space, the first dielectric wall having a first width dimension; and a base coupled to the trip unit to form the circuit breaker, wherein the base includes a first dielectric member configured to engage the first dielectric wall of the trip unit, wherein the dielectric member or the first dielectric wall has a dielectric protrusion that extends away from and along a peripheral edge of the dielectric member or the first dielectric wall to allow the trip unit to move relative to the base during a trip event while maintaining a dielectric and physical barrier between the trip unit and the base, the dielectric protrusion having a width that is less than a width of the dielectric member or the first dielectric wall along an entirety of the dielectric protrusion;

wherein the other of the first dielectric member and the first dielectric wall has a groove formed of dielectric material for receiving the dielectric protrusion of the dielectric member or the first dielectric wall;

wherein the dielectric protrusion is configured to be slidably inserted within the groove formed of dielectric material when the trip unit is coupled to the base to allow the trip unit to move relative to the base during a trip event while maintaining the dielectric and physical barrier between the trip unit and the base.

* * * * *